US006984350B2

(12) United States Patent
Kuroiwa et al.

(10) Patent No.: US 6,984,350 B2
(45) Date of Patent: Jan. 10, 2006

(54) METHOD OF AND APPARATUS FOR MANUFACTURING A WEB HAVING FILAMENTS ALIGNED IN A TRANSVERSE DIRECTION

(75) Inventors: Yuki Kuroiwa, Saitama (JP); Kazuhiko Kurihara, Tokyo (JP); Kazuhiro Yabe, Tokyo (JP); Shin-ichi Umejima, Chiba (JP); Yoshiro Morino, Chiba (JP)

(73) Assignees: Nippon Petrochemicals Co., Ltd., Tokyo (JP); Polymer Processing Research Institute Ltd., Tokyo (JP)

( * ) Notice: Subject to any disclaimer, the term of this patent is extended or adjusted under 35 U.S.C. 154(b) by 259 days.

(21) Appl. No.: 10/082,142

(22) Filed: Feb. 26, 2002

(65) Prior Publication Data

US 2002/0158362 A1 Oct. 31, 2002

(30) Foreign Application Priority Data

Feb. 27, 2001 (JP) ..... 2001-052536

(51) Int. Cl.
*D04H 3/05* (2006.01)
*D01D 5/098* (2006.01)

(52) U.S. Cl. ..... 264/103; 264/70; 264/71; 264/210.8; 264/211.14; 264/555

(58) Field of Classification Search ..... 264/70, 264/71, 103, 210.2, 210.8, 211.14, 555; 425/72.2, 425/377

See application file for complete search history.

(56) References Cited

U.S. PATENT DOCUMENTS 3,220,812 A * 11/1965 Underwood ..... 65/522
3,806,289 A * 4/1974 Schwarz ..... 425/72.2
3,959,421 A * 5/1976 Weber et al. ..... 264/6
4,163,305 A 8/1979 Semjonow et al.
4,334,340 A * 6/1982 Reba ..... 19/299
4,637,104 A * 1/1987 Mente ..... 28/283
5,045,271 A * 9/1991 Mente et al. ..... 264/555
5,075,068 A * 12/1991 Milligan et al. ..... 264/555
5,080,569 A * 1/1992 Gubernick et al. ..... 425/7
5,312,500 A 5/1994 Kurihara et al.
5,807,795 A 9/1998 Lau et al.
6,048,808 A * 4/2000 Kurihara et al. ..... 442/361

(Continued)

FOREIGN PATENT DOCUMENTS

DE 24 21 401 * 11/1975

(Continued)

*Primary Examiner*—Melvin Mayes
(74) *Attorney, Agent, or Firm*—Oblon, Spivak, McClelland, Maier & Neustadt, P.C.

(57) ABSTRACT

An apparatus for manufacturing a transversely aligned web has a spinning device provided with a plurality of nozzles for extruding molten polymer as filaments, and a conveyor on which the filaments spun by the spinning device are piled and traveling in a direction cross to the direction of array of the nozzles. The spinning device is provided with a high-speed fluid blowing unit for blowing a high-speed fluid in a direction parallel with a direction in which the filaments are extruded from the nozzles so as to attenuate the filaments. Further, the apparatus for manufacturing the transversely aligned web has at least one air stream vibrating mechanism for cyclically changing the flowing direction of the high-speed fluid blown from the high-speed fluid blowing unit in a direction cross to the machine direction of the conveyor. The filaments are vibrated in a direction cross to the machine direction of the conveyor, owing to the high-speed fluid by the air stream vibrating unit.

16 Claims, 9 Drawing Sheets

U.S. PATENT DOCUMENTS 6,132,661 A * 10/2000 Kurihara et al. ..... 264/210.7
6,524,521 B1 * 2/2003 Kuroiwa et al. ..... 264/555

FOREIGN PATENT DOCUMENTS

| | | |
|---|---|---|
| EP | 1 088 916 | 4/2001 |
| FR | 2 217 459 | 9/1974 |
| JP | 2-242960 | 9/1990 |
| JP | 3-36948 | 6/1991 |
| JP | 2612203 | 2/1997 |
| WO | WO96/17121 | 6/1996 |

* cited by examiner

METHOD OF AND APPARATUS FOR MANUFACTURING A WEB HAVING FILAMENTS ALIGNED IN A TRANSVERSE DIRECTION

BACKGROUND OF THE INVENTION

1. Field of the Invention

The present invention relates to a method of and an apparatus for manufacturing a web composed of a plurality of filaments aligned in a transverse direction.

The web obtained according to the present invention is excellent in mechanical strength and dimensional stability, and can be used as a raw material web for nonwoven fabric needed to have strength in one direction and for cross laminated nonwoven fabric.

2. Description of the Related Art

As a method of manufacturing a nonwoven fabric, there have been a spun-bonding method, a melt-blowing method and a flush-spun method, all these methods being conducted during spinning yarns therefore, and the obtained fabric will be hereinafter referred to as a spunbonded nonwoven fabric in broad sense. Since nonwoven fabrics manufactured by the above-mentioned methods are economical and mass-producible, these methods are the mainstream of nonwoven fabrics.

These conventional spunbonded nonwoven fabrics in broad sense are randomly nonwoven fabrics in which filaments are randomly aligned, and therefore many of them are of small mechanical strength and have no dimensional stability. The present inventors have invented a stretching method of nonwoven fabrics and a method of manufacturing nonwoven fabric in which nonwoven fabrics manufactured by the stretching method are laminated in a manner such that respective fabrics are aligned to be perpendicularly to one another in order to eliminate the drawbacks the conventional nonwoven fabric (see Japanese Patent Publication No. 36948/91).

Also, the present inventors have conducted research and development in a web having filaments aligned in a transverse direction and capable of being used as raw material web for the above-mentioned cross laminated nonwoven fabric (Japanese Patent Nos. 1992584 (Japanese Laid-open Patent Publication No. 242960/90) and 2612203 (Japanese Laid-open Patent Publication No. 269859/90)). The web having filaments aligned in the transverse direction be hereinafter referred to as a transversely aligned web.

Due to the recent advance in the nonwoven fabric industry, it has been further desired that the cross laminated nonwoven fabric be more improved in its quality and productivity.

Nevertheless, although the manufacturing method of the transversely aligned web by the spraying method as disclosed in Japanese Patent Publication No. 36948/91 and Japanese Patent No. 1992584 can be an effective means for aligning filaments in the transverse direction, due to a large amount of extrusion as per one nozzle, and a good alignability of filaments in the transverse direction, a single spinning gun can be provided with only one nozzle. Thus, even if productivity as per one nozzle is large, many spinning guns are required in order to increase the amount of production. Also, the width of web obtained by this method must be limited to at most approximately 400 through 500 mm, and it is difficult to produce web having a larger width. Further, when it is tried to increase the alignability of filaments in the transverse direction, each of the side edge portions of the web (it is often referred to as a selvage) becomes large in thickness, and therefore the yield of web must be reduced and the uniformity of the basis weight of the web is liable to deteriorate.

On the other hand, in a means for realizing the transverse alignment of filaments by applying various contrivances to a conveyor as disclosed in Japanese Patent No. 2612203, a spinning means employed in the spun-bonding method in broad sense may be used while obtaining a good productivity. However, the alignability of filaments in a transverse direction is insufficient.

Generally, in order to obtain web in which filaments are sufficiently aligned in a transverse direction, it is not sufficient to align the filaments in the transverse direction in the spinning process. Also, the mechanical strength of filaments per se obtained in the spinning process is generally small. It is considered that the best method for increasing the alignability of filaments in the transverse direction and the mechanical strength of filaments per se is to stretch the web in the transverse direction. However, after the spinning process, generally the web cannot well be stretched in the transverse direction because the filaments are not well aligned transversely and are not sufficiently cooled, and it is difficult to stretch the web to high mechanical strength at a high magnification.

SUMMARY OF THE INVENTION

It is an object of the present invention to provide a method of and an apparatus for manufacturing a transversely aligned web that the alignability of filaments in a transverse direction is increased, a high yield in the manufacture of the web can be achieved, and the manufacture the web having a large width can be achieved.

Another object of the present invention is to provide a method of and an apparatus for manufacturing a transversely aligned web, which are able to directly employ a spinning means as used in the spun-bonding method in broad sense, so that productivity of the web can be increased.

A further object of the present invention is to provide an apparatus for manufacturing a transversely aligned web, which has simple construction while realizing a stable production of the transversely aligned web having filaments highly aligned in a transverse direction.

A still further object of the present invention is to provide a method of and an apparatus for manufacturing a transversely aligned web, which are able to manufacture the transversely aligned web having a good stretching ability and an uniform physical property such as mechanical strength of the stretched web and a uniform distribution in the basis weight.

In order to achieve the above-mentioned objects, a method of manufacturing a transversely aligned web according to the present invention comprises the steps of preparing a spinning means having a plurality of nozzles aligned in parallel with an machine direction of a conveyer for extruding molten polymer in the form of filaments, a high speed fluid blowing unit for blowing a high speed fluid in a direction parallel with extruding direction of the filaments in order to attenuate the filaments extruded by the nozzles, and at least one air stream vibrating means for cyclically changing the flowing direction of the high speed fluid blown from the high speed fluid blowing unit in the direction cross to the machine direction of the conveyor. Further, the method of manufacturing the transversely aligned web comprises the steps of extruding the molten polymer from the nozzles in the form of filaments, blowing the high speed fluid to apply a frictional force of the high speed fluid to the filaments extruded from the nozzles thereby attenuating the filaments, and changing cyclically the flow direction of the high-speed fluid by the air stream vibrating means to thereby, while cyclically changing the direction of the filaments in the direction cross to the machine direction, depositing the filaments onto the conveyor.

An apparatus for manufacturing a transversely aligned web according to the present invention comprises a spinning means provided with a plurality of nozzles aligned in an array for extruding molten polymer in the form of filaments and a high-speed fluid blowing unit for blowing a high-speed fluid in a direction parallel with a direction in which the filaments are extruded to attenuate the filaments, a conveyor traveling in a direction parallel with the arranging direction of the nozzles and permitting the filaments attenuated by the high-speed fluid to be piled thereon, and at least one air stream vibrating means for cyclically changing the direction of the high-speed fluid in the direction cross to the machine direction of the conveyor.

In the present invention, the filaments extruded from the nozzles are attenuated by the frictional force applied by the high-speed fluid and piled onto the conveyor to form a web.

Since the flow direction of the high speed fluid is cyclically changed by the air stream vibrating means in the direction cross to the machine direction of the conveyor, according to the change in the flow direction of the high speed fluid, the filaments extruded from the nozzles are piled onto the conveyor while cyclically being vibrated in the direction cross to the machine direction of the conveyor. Thus, the web in which the filaments are well aligned in the transverse direction can be obtained.

In the present invention, a spun-bonding method in broad sense is employed for spinning the filaments. This is because the spun-bonding method is the most refined method as a spinning method, and excellent both economically and mass productivity. The spun-bonding method in broad sense commonly extrudes polymer in the molten condition (although the dissolution by a solvent may be included in the present invention, the term "molten" is used throughout this specification for the brevity sake) in the form of filaments into a fluid flowing at a high speed close to the sound speed, and attenuates the filaments by the frictional force of the high-speed flow of the fluid.

As a result of the studies conducted by the present inventors, it has been found that when the high-speed fluid flow used for attenuating the filaments is cyclically changed in the direction cross to the machine direction of the conveyor, the alignability of the filaments can be improved. It should be understood that if any wall surface were disposed in the high-speed fluid flow, when the wall surface comes close to the high-speed fluid flow, the high-speed fluid flow per se tends to move away from the wall surface, and when the wall surface comes away from the high-speed fluid flow, the high-speed fluid tends to flow along the wall surface (Coanda effect). Thus, while the filaments are flowing in the flow of the high-speed fluid to be attenuated, if a wall surface disposed aside the fluid flow is cyclically and repeatedly moved close to and away from the high-speed fluid flow, the filaments in the fluid flow are extensively vibrated to be eventually folded. In the present invention, an air stream vibrating means having a wall surface disposed in a region of the high-speed fluid is used.

By disposing a plurality of air stream vibrating means, the width of vibratory movement of the filaments becomes larger and accordingly a web having a large width can be in turn obtained. Further, when the high-speed fluid blown from the spinning means toward the conveyor is circulated via a passageway differ from a passageway that permits the high-speed fluid to pass through from the spinning means to the conveyor, effective use of the high-speed fluid can be achieved. Thus, the attenuating of the filaments can be promoted, and the width of the web on the conveyor can be increased. Furthermore, if some misty liquid is sprayed toward the high-speed fluid to cool the fluid, the molecular orientation of the filaments can be reduced, and therefore the ability of stretching of the filaments in the later process of stretching of the filaments in the transverse direction for increasing the transverse strength of web can be increased.

The air stream vibrating means might be comprised of any kind of mechanism if such mechanism is cahngeable the flowing direction of the high-speed fluid in the direction cross to the machine direction of the conveyor. In order to promote the above-mentioned Coanda effect, the air stream vibrating means may be provided with a wall surface that is changeable the distance against the high-speed fluid cyclically. In this case, the wall surface may be a circumferential wall surface of a rod-like member having its central axis aligned to be parallel with the machine direction of the conveyor and rotatable about the axis, and having an elliptical cross section, a circular cross section in which at least one projection is formed, or a polygonal cross section. The wall surface may further be a main surface of a plate member which is disposed to face against the high-speed fluid and is swingable around an axis parallel with the machine direction of the conveyor.

As described above, in the present invention, the flowing direction of high-speed fluid for attenuating the filaments is cyclically changed in the direction cross to the machine direction of the conveyor to vibrate the filaments in that direction, so that the alignability of the filaments in the transverse direction may be increased to resultantly obtain the web having a large width thereof, increased transverse strength and good dimensional stability. Furthermore, since an ordinary spinning means of the spun-bonding method in broad sense may be utilized at it is, the construction of the apparatus may be simple, and the transversely aligned web may be stably manufactured at a high productivity. Further, cooling the high-speed fluid makes it possible to increase the ability of stretching in the transverse direction and to enhance the physical properties including a mechanical strength after the stretching, and a uniformity in the distribution of the mass.

In the present invention, the term "longitudinal direction" used for explaining the direction of alignment of the filaments and the stretching direction, means the machine direction in which the nonwoven fabric or the web is manufactured, namely, the direction in which the nonwoven fabric or the web is fed, and the term "transverse direction" means the direction cross to the longitudinal direction, namely the direction of width of the nonwoven fabric or the web.

The above and other objects, features and advantages of the present invention will become apparent from the following description with reference to the accompanying drawings, which illustrate examples of the present invention.

DESCRIPTION OF THE PREFERRED EMBODIMENTS

Figure 1:
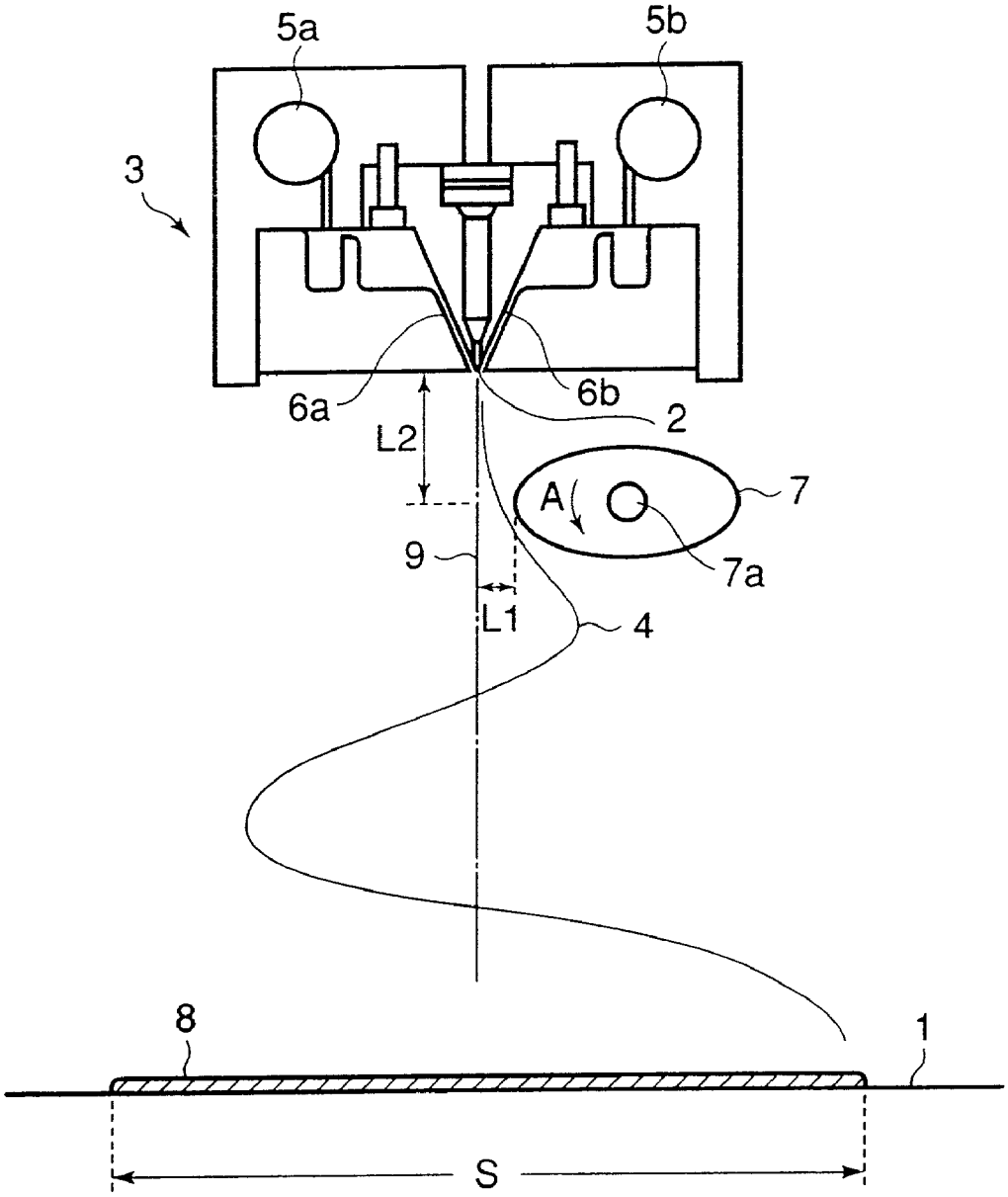
FIG. 1 is a schematic front elevation view of a web manufacturing apparatus employing a melt-blow method, according to an embodiment of the present invention.

Referring to FIG. 1, an apparatus for manufacturing a web according to an embodiment of the present invention, employing a melt-blow method is shown in a schematic front elevational view. The apparatus shown in FIG. 1 has melt-blow die 3 for spinning filaments 4 conveyor 1 for conveying spun filaments 4, and rod-like body 7 used for cyclically changing the flow direction of filament 4 spun from melt-blow die 3. In FIG. 1, melt-blow die 3 is cross-sectioned to show the internal construction thereof.

Melt-blow die 3 has, at its extreme end (lower ends), a plurality of nozzles 2 aligned in a direction perpendicular to the sheet of FIG. 1. A molten resin delivered from a gear pump (not shown) is extruded from respective nozzles 2 to form a number of filaments 4. On both sides of each nozzle 2, there are provided air reservoirs 5*a* and 5*b*. A highly-pressurized air heated to a temperature equal to or higher than the melting point of the resin is introduced into air reservoirs 5*a* and 5*b*, and is then blown from slits 6*a* and 6*b* fluidly communicating with air reservoirs 5*a* and 5*b* and opening at the end of melt-blow die 3 toward filaments 4. Thus, a high-speed air stream substantially parallel with the direction of extrusion of filaments 4 from nozzles 2 is produced. This high-speed air stream applies a frictional force to filaments 4 extruded from nozzles 2 while keeping their molten condition, so as to draft filaments 4 thereby attenuating filaments 4. The above-mentioned mechanism is the same as mechanism employed in the ordinary melt-blow method. The temperature of the high-speed air stream is kept at a temperature equal to or more than 80° C. or preferably 120° C. higher than the spinning temperature of filaments 4.

In the method of filaments 4 with melt blow die 3, since the temperature of filaments 4 immediately after they are extruded from nozzles 2 can be made sufficiently higher than the melting point of filaments 4 by setting the temperature of the high-speed air stream at a high temperature, the molecular orientation of filaments 4 can be reduced.

Below melt blow die 3, conveyor 1 is disposed. Conveyor 1 is trained around conveyor rollers rotated by a non-illustrated drive source and other rollers (not shown). The rotation of these rollers drives conveyor 1 and therefore web 8 obtained by the accumulation of filaments 4 which are extruded from nozzles 2 is conveyed from a position internally located apart from the sheet surface of FIG. 1 toward this side or from this side toward the position internally located apart from the sheet surface of FIG. 1.

Between melt-blow die 3 and conveyor 1, rod-like body 7 having an elliptical cross section is disposed in the region where the high-speed air stream is blown from slits 6*a* and 6*b*. Rod-like body 7 has rotating axis 7*a* extending in parallel with the conveying direction of web 8 on conveyor 1, and is rotated about axis 7*a* in a direction shown by arrow "A".

It is generally known that when a wall is located adjacent to a high-speed jet of air or liquid, even if the direction of the jet's axis and the direction of the wall surface are different, the jet tends to flow along the wall surface. This phenomenon is referred to as Coanda effect. Thus, rod-like body 7 changes the direction of flow of filaments 4 by utilizing this phenomenon.

The change of the flowing direction of filaments 4 due to the rotation of rod-like body 7 will be described below with reference to FIGS. 2*a* through 2*c*.

Figure 2A:
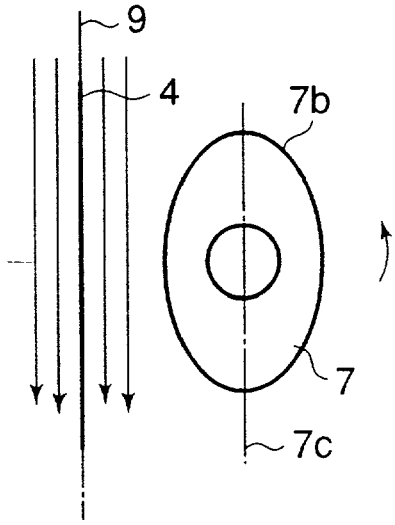
FIGS. 2*a* through 2*c* are views for explaining a change in the flowing direction of the filaments due to the rod-like member in the apparatus shown in FIG. 1.

In the state shown in FIG. 2*a*, major axis 7*c* of rod-like body 7 at the elliptical end face thereof is approximately parallel with air stream axis 9 of the high-speed air stream, and the distance between circumferential surface 7*b* of rod-like body 7 and air stream axis 9 is maximum. In this state, a portion of circumferential surface 7*b* located at a position closest to air stream axis 9 is brought into a condition approximately parallel with air stream axis 9, and filaments 4 tend to flow along air stream axis 9.

Figure 2B:
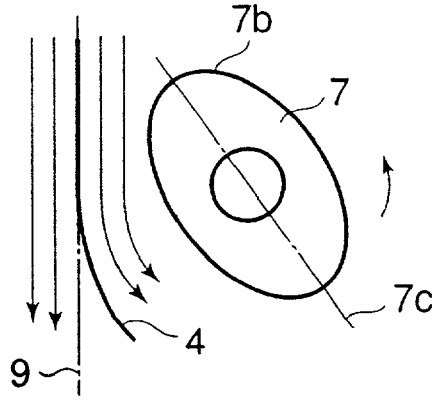

When rod-like body 7 rotates to a position where, as shown in FIG. 2*b*, an inclination appears between major axis 7*c* and air stream axis 9, a distance between circumferential surface 7*b* of rod-like body 7 and air stream axis 9 gradually becomes small, so that filaments 4 tend to be attracted toward circumferential surface 7*b*. In this state, since rod-like body 7 has an elliptical cross section, the distance between circumferential surface 7*b* and air stream axis 9 is varied so as to gradually increase in a direction toward downstream of high-speed air stream. Accordingly, high-speed air stream tends to flow along circumferential surface 7*b* so that filaments 4 are attracted toward rod-like body 7.

Figure 2C:
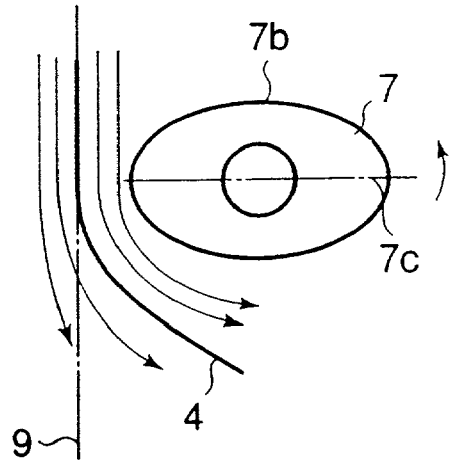

When rod-like body 7 further rotates to the state as shown in FIG. 2*c*, i.e., a state in which major axis 7*c* of rod-like body 7 at the elliptical end is positioned to be cross to air stream axis 9, the distance between circumferential surface 7*b* of rod-like body 7 and air stream axis 9 becomes minimum. Thus, filaments 4 have a strong tendency to be attracted toward circumferential surface 7*b*. Further, on the downstream from a position where the distance between circumferential surface 7*b* and air stream axis 9 is the smallest with respect to flow direction of high-speed air stream, an angle of circumferential surface 7*b* relative to air stream axis 9 becomes larger than the state as shown in FIG. 2*b*. Therefore, filaments 4 are attracted toward rod-like body 7 more than the state of FIG. 2*b*.

When rod-like body 7 further rotates from the state as shown in FIG. 2*c*, circumferential surface 7*b* of rod-like body 7 takes a posture in which circumferential surface 7*b* gradually comes close to air stream axis 9 from an upstream to a downstream with regard to flowing direction of the high-speed air stream. Thus, the flow of filaments 4 is changed so that a flowing direction thereof is repelled away from the circumferential surface of rod-like body 7. Thereafter, an angle of circumferential surface 7*b* relative to air stream axis 9 becomes smaller, and the flowing direction of filaments 4 approach a condition where it is parallel with air stream axis 9. Then, when rod-like body 7 rotates 180 degrees from the state as shown in FIG. 2*a*, the rod-like body 7 reaches the same state as that shown in FIG. 2*a*. Thereafter, the above continuous process is repeated.

Thus, it will be understood that due to the rotation of rod-like body 7, filaments 4 can be cyclically vibrated. Referring to FIG. 1, since rotating axis 7*a* of rod-like body 7 is aligned to be parallel with the conveying direction of web 8 by conveyor 1, filaments 4 are vibrated in the direction cross to the conveying direction by conveyor 1, i.e., the direction of width of conveyor 1. Thus, web 8 is obtained on conveyor 1, in which filaments 4 are aligned in a transverse direction of conveyor 1 to form web 8 having a width "S" thereof.

Now, in the state where circumferential surface 7*b* of rod-like body 7 comes nearest to air stream axis 9, a distance between air stream axis 9 and circumferential surface 7*b* is defined "L1", and a distance measured on air stream axis 9 from the ends of nozzles 2 to a position where rod-like body 7 is nearest to air stream axis 9 is defined "L2". Then, the smaller "L1" and "L2" are, the larger the width "S" of an obtained web 8 will become. However, if "L1" is too small, such a trouble might occur in which filament 4 will be wound around rod-like body 7. Further, "L2" will be delimited for itself from an extent of the cross section of rod-like body 7 or the like. On the other hand, when "L1" and "L2" are excessively large, the effect of vibrating filaments 4 by circumferential surface 7*b* will be reduced. Thus, it is preferable that L1 is 30 mm or less, or further preferably 15 mm or less. Most preferably, L1 is 10 mm or less. "L2" is preferably 80 mm or less, or further preferably 55 mm or less. Most preferably, L2 is 52 mm or less. Nevertheless, rod-like body 7 should be disposed at a position where it does not collide with filaments 4 during the web forming operation.

Also, the extent to which filaments 4 are vibrated depends on the speed of the high-speed air stream and a rotating speed of rod-like body 7. If changes of the distance between air stream axis 9 and circumferential surface 7*b*, which is caused by the rotation of rod-like body 7, are considered as vibrations of circumferential surface 7*b*, there exists the specific frequency of circumferential surface 7*b* which makes maximum the extent to which filaments 4 are vibrated. Except for this specific frequency, the frequency of circumferential surface 7*b* and the natural frequency of the high-speed air stream are different from one another, and thus the extent to which filaments 4 are vibrated will be reduced. The above-mentioned specific frequency will vary depending on the spinning condition, but when filaments 4 spun by a generally accepted spinning means is vibrated, the specific frequency is preferably in the range of 5 Hz through 30 Hz, or more preferably be in the range from 10 Hz through 20 Hz. Most preferably, the specific frequency should be in the range of 12 Hz through 18 Hz. The speed of the high-speed air stream is 10 m/sec or higher, or preferably 15 m/sec or higher. When the speed of the high-speed air stream is less than 10 m/sec, it might occur that filaments 4 cannot be sufficiently vibrated.

Although the above-described example has explained a case where rod-like body 7 rotates in a direction identical with flowing direction of filaments 4, an identical effect could be obtained from a case where rod-like body 7 rotates in a direction reverse to the flowing direction of filaments 4 even if a distance between the circumferential surface of rod-like body 7 and the air stream could be changed. Further, as described in detail later, wall surface might be moved by a suitable mechanism that causes the movement of the wall surface by a method other than a rotating method, e.g., a vibrating method.

The length of rod-like body 7 should desirably be larger than the width of the group of filaments spun by melt blow die 3 (refer to FIG. 1) by 100 mm or more. If the length of rod-like body 7 is less than the above-mentioned length, the flow direction of the high-speed air stream cannot be sufficiently changed at the side ends of the group of filaments, while making it difficult to transversely align filaments 4 at the side ends of the group of filaments.

As described above, rod-like body 7 vibrates the flowing direction of the high-speed air stream in the transverse direction so as to vibrate filaments 4 in the transverse direction thereby allowing filaments 4 to be piled onto conveyor 1 while forming web 8. Thus, the alignability of filaments 4 in the transverse direction on conveyor 1 can be improved and the width of folding of filaments 4 in the transverse direction, i.e., width "S" of web 8 can be increased. According to the present embodiment, web 8 having width "S" of 500 mm or more can be easily obtained, and a remarkable effect can be acquired in that the alignability of filaments 4 and the width of holding of filaments 4 can be increased. Further, the above alignment of filaments 4 is effective in increasing the mechanical strength of web 8 in the transverse direction.

Also, that the width of holding of filaments 4 is increased is very effective not only in aligning filaments 4 in the transverse direction, but also in manufacturing web 8 having a large transverse width at a good productivity, in spite of the fact that only single nozzle 2 is needed in a transverse direction of web 8.

Although obtained web 8 may be used as it is, web 8 might be stretched in a transverse direction as required, and might be subjected to a post-processing such as a partial bonding processing by the use of either a heating processing or a thermal embossing treatment. Web 8 might further be subjected to a combination of the stretching and the post-processing.

Figure 3:
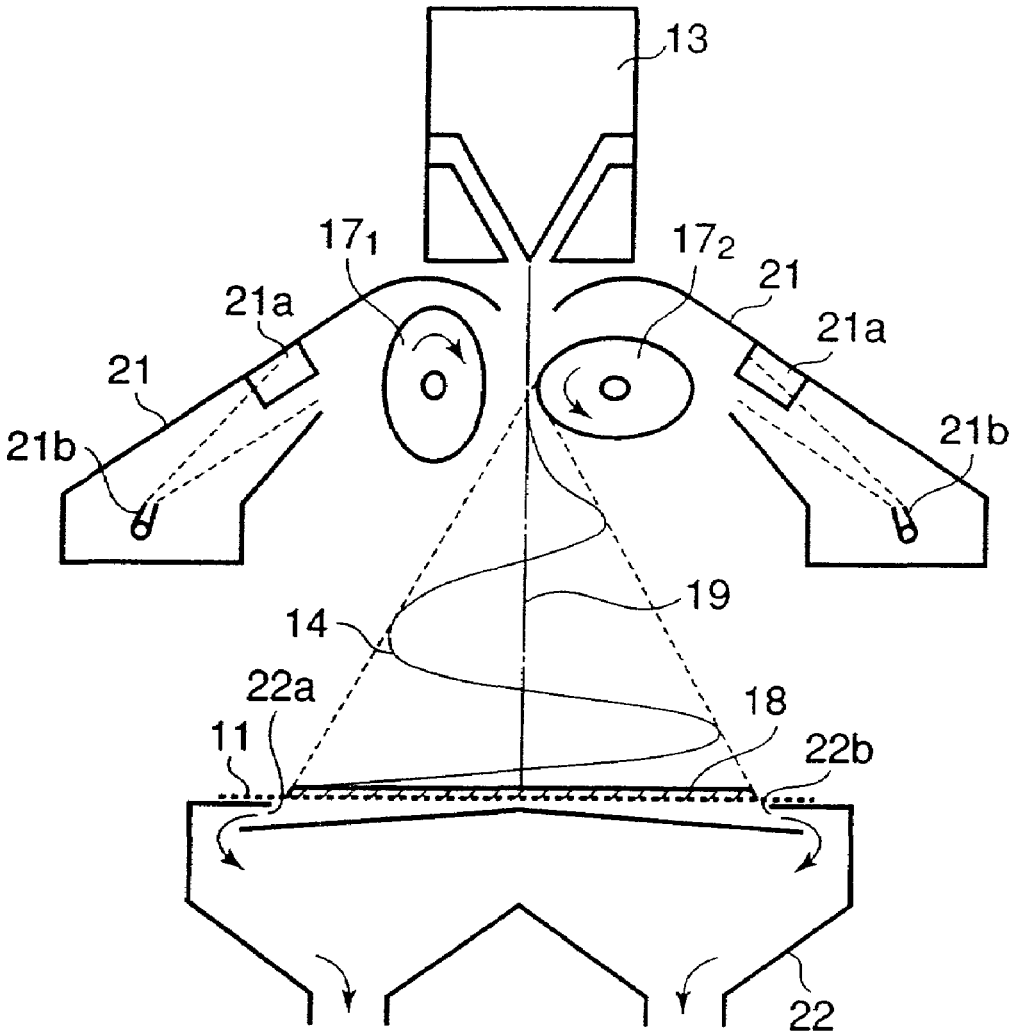
FIG. 3 is a schematic front elevational view of the web manufacturing apparatus according to another embodiment of the present invention.

FIG. 3 is a schematic front elevational view of a web manufacturing apparatus according to another embodiment of the present invention. The apparatus shown in FIG. 3 is different from the apparatus shown in FIG. 1 in that the former apparatus is provided with two rod-like bodies $\mathbf{17}_1$ and $\mathbf{17}_2$ having an elliptical cross section similar to that shown in FIG. 1, respectively, cooling boxes 21, and a suction box 22 disposed underside conveyor 1.

Respective rod-like bodies $\mathbf{17}_1$ and $\mathbf{17}_2$ are arranged in a manner such that the rotating axis of each body is parallel with an machine direction of conveyor 11. Further, respective rod-like bodies $\mathbf{17}_1$ and $\mathbf{17}_2$ are arranged to be symmetrical with respect to air stream axis 19 of the high-speed air stream produced by melt blow die 13, to be parallel with one another, and to be spaced apart from one another in a direction cross to the machine direction of conveyor 11. Further, respective rod-like bodies $\mathbf{17}_1$ and $\mathbf{17}_1$ are disposed to be angularly shifted from one another by an amount of 90 degrees but are rotated in synchronous with one another.

Cooling boxes 21 are arranged so that each of them opposes to one of rod-like bodies $\mathbf{17}_1$ and $\mathbf{17}_2$, and are provided with spray nozzles 21*b* for spraying water in the mist condition into the high-speed air stream for cooling filament 14 and baffle plates 21*a*, respectively.

Conveyor 11 is formed of a mesh conveyor, and suction box 22 is disposed on the backside of the surface of conveyor 11 for allowing filaments 4 to be piled thereon. Suction box 22 is provided with suction ports 22*a* and 22*b* opening at opposite end positions in transverse direction of conveyor 11. Thus, filaments 14 can be surely caught on conveyor 11 in a region extending between one and other suction ports 22*a* and 22*b*, and as a result, web 18 having a desired width can be obtained.

In the web manufacturing apparatus shown in FIG. 3, filaments 14 extruded from melt blow dies 13 and carried by the high-speed air stream passes through a region between a pair of rod-like bodies $\mathbf{17}_1$ and $\mathbf{17}_2$.

As described above, respective rod-like bodies $\mathbf{17}_1$ and $\mathbf{17}_2$ rotate, respectively, while maintaining such an arrangement that both bodies are angularly shifted 90 degrees from one another, and therefore when filaments 14 pass through the region between rod-like bodies $\mathbf{17}_1$ and $\mathbf{17}_2$, filaments 14 are simultaneously subjected to both attracting and repelling actions by both rod-like bodies, as explained with reference to FIGS. 2*a* through 2*c*. That is to say, when filaments 14 are attracted toward rod-like body $\mathbf{17}_1$, filaments 14 are repelled away from other rod-like body $\mathbf{17}_2$. On the contrary, when filaments 14 are repelled away from rod-like body $\mathbf{17}_1$, filaments 14 are attracted toward other rod-like body $\mathbf{17}_2$. As a result, an extent to which filaments 14 are vibrated is increased, and accordingly an alignability of filaments 14 in the transverse direction can be enhanced to result in an increase in the transverse strength of web 18. Further, since two rod-like bodies $\mathbf{17}_1$ and $\mathbf{17}_2$ are arranged to be symmetrical with respect to air stream axis 19, the vibration of filaments 14 in the left and right hand directions can be balanced with respect to air stream axis 19. Thus, a quality and yield of web 18 obtained by the apparatus of FIG. 3 can be improved.

In the embodiment of FIG. 3, although respective rod-like bodies $\mathbf{17}_1$ and $\mathbf{17}_2$ are arranged to be angularly shifted 90 degrees to one another, the amount of shift thereof might not need to be limited to only 90 degrees, if respective bodies $\mathbf{17}_1$ and $\mathbf{17}_2$ were arranged so as to provide simultaneous attracting and repelling actions to filaments 14.

Further, in the embodiment of FIG. 3, such an arrangement is adopted in that two rod-like bodies $\mathbf{17}_1$ and $\mathbf{17}_2$ are arranged to be parallel with one another and symmetrical with respect to air stream axis 19. However, if another arrangement is adopted in which a plurality of rod-like bodies (the air stream vibrating mechanisms) would be arranged rectilinearly in a direction from melt blow die 13 toward conveyor 11, it is possible to increase the width of vibration of filaments 14. Further, a combination of the above-mentioned parallel and rectilinear arrangements of a plurality of air stream vibrating mechanisms might be used for the construction of a web manufacturing apparatus of the present invention.

Figure 4:
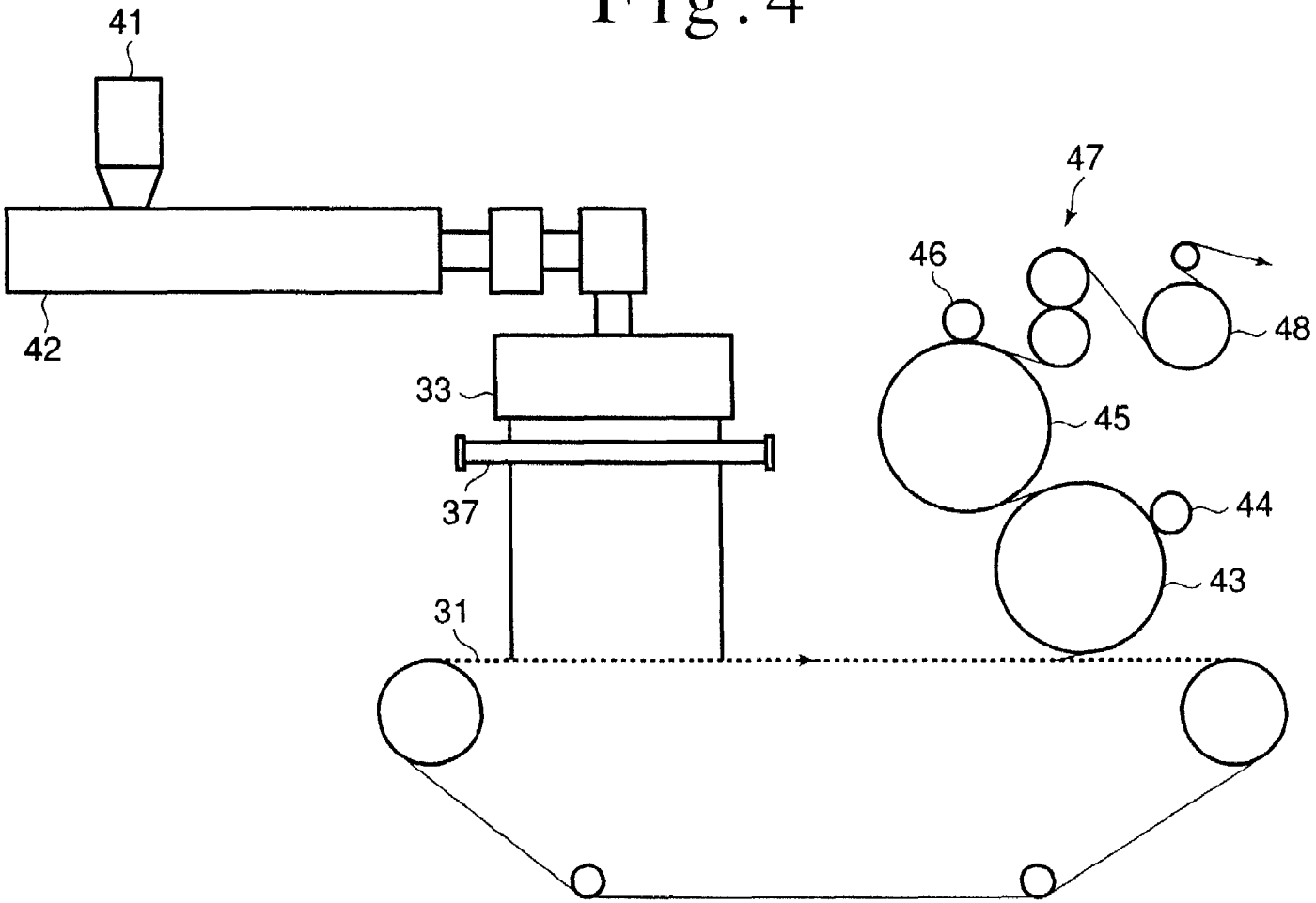
FIG. 4 is a schematic side view of the web manufacturing apparatus according to a further embodiment of the present invention.

FIG. 4 is a schematic side view of a web manufacturing apparatus according to a further embodiment of the present invention. Similar to the apparatus of FIG. 1, the apparatus of FIG. 4 also adopts an arrangement in which a filaments extruded from melt blow die 33 is carried by a high-speed air stream and is cyclically vibrated in a direction cross to the conveying direction thereof by conveyor 31 until the filaments are piled on conveyor 31. However, the apparatus of FIG. 4 is provided with a mechanism for applying a thermal embossing treatment to the spun web to thereby partially connecting filaments. In FIG. 4, there are also shown hopper 41 for receiving resin for forming filaments, and extruding mechanism 42 for plasticizing the resin supplied by hopper 41 and for supplying it to melt blow die 33.

In FIG. 4, the web piled on conveyor 31 is conveyed by conveyor 31 in a shown right hand direction, and is then transferred to first iron roller 43, which is heated to an appropriate temperature. Thereafter, the web is nipped by first iron roller 43 and first embossing roller 44. First embossing roller 44 has an outer circumference in which projection extending in a circumferential direction are formed so as to apply an embossing treatment to the web for forming thereon a longitudinal line pattern. Subsequently, the web is transferred to second iron roller 45 which is heated to an appropriate temperature so that it is nipped by second iron roller 45 and second embossing roller 46. Second embossing roller 46 is provided with an outer circumference thereof 41 having many projections at both side ends, so that embossing treatment is applied to the side ends of the web for reinforcing those ends. It should be understood that although respective embossing rollers 44 and 46 are not particularly heated, preferably, these embossing rollers 44 and 46 should be also heated to ensure the application of the embossing treatment to the web.

The web having been subjected to the embossing treatment is received by receipt nipping roller 47, and is then further transferred to cooling roller 48 where the web is cooled. The cooled web is carried to the subsequent manufacturing step.

Figure 5:
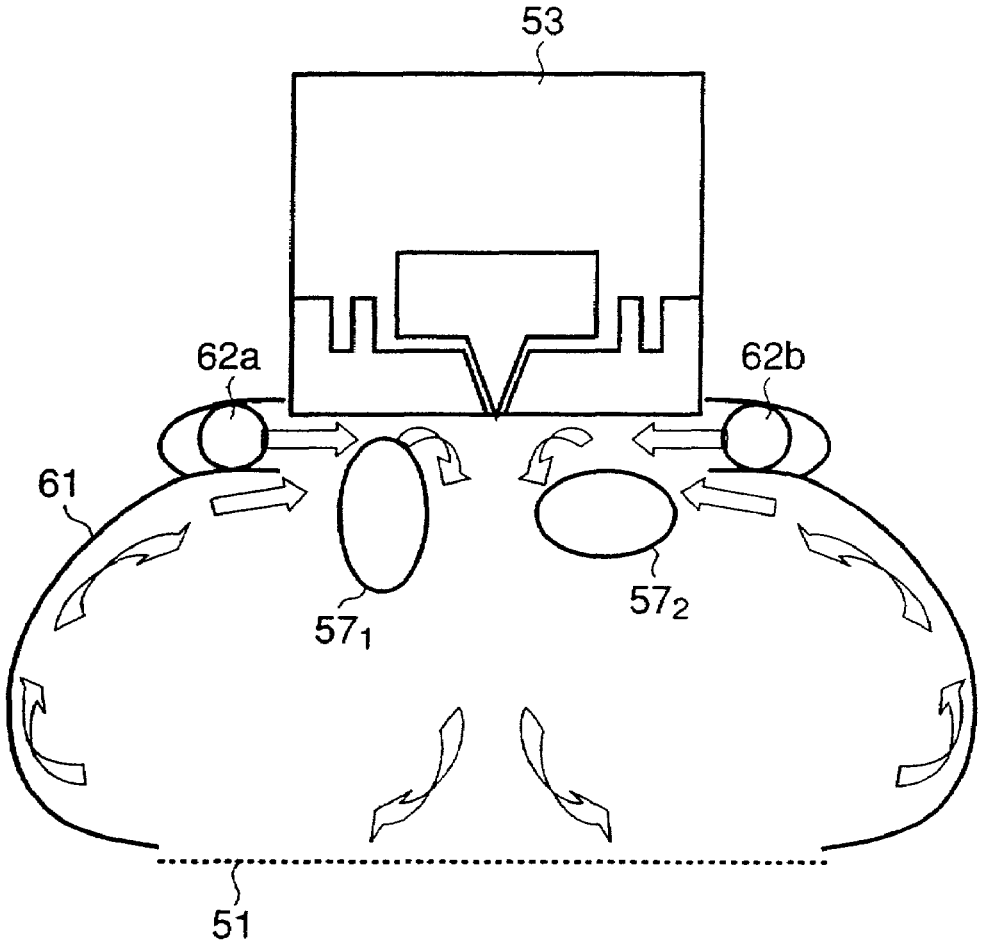
FIG. 5 is a schematic front elevational view of the web manufacturing apparatus according to a further embodiment of the present invention.

FIG. 5 is a schematic front elevational view for illustrating a web manufacturing apparatus according to a further embodiment of the present invention.

The apparatus of FIG. 5 has a spinning chamber enclosed by side plates 61 arranged at widthwise opposite side ends of conveyor 51 so as to enclose a space extending between melt blow die 53 and conveyor 51. Rod-like bodies $\mathbf{57}_1$ and $\mathbf{57}_2$ are substantially identical with those of the embodiment of FIG. 3, and are arranged within the spinning chamber. Side plates 61 are formed so as to ovally expand outwardly in transverse direction of conveyor 51.

Provision of side plates 61 for forming the spinning chamber permits the high temperature and high-speed air stream, which is blown from melt blow die 53 toward conveyor 51, to change its flowing direction on conveyor 51 within the spinning chamber. Thus, the high-speed air stream is moved upward along side plates 61 to return to above rod-like bodies $\mathbf{57}_1$ and $\mathbf{57}_2$. Since the high-speed air stream is circulated along a passage different from the air stream to be directed from melt blow die 53 to conveyor 51, effective use of the high temperature air stream can be made for maintaining the high temperature of the high-speed air stream. Hereby, attenuating of the filaments can be promoted to result in increasing the width of the web on conveyor 51. Further, the above-mentioned oval shape of side plates 61 allows the high-speed air stream to be circulated without causing any turbulence therein, and as a result, the high-speed air stream can be effectively used for the manufacture of the web.

In the embodiment of FIG. 5, hot air blowing nozzles 62*a* and 62*b* for blowing a hot air of which the temperature is higher than the melting point of filaments toward the high-speed air stream blown from melt blow die 53 are disposed above rod-like bodies $\mathbf{57}_1$ and $\mathbf{57}_1$ within the spinning chamber. Hereby, the hot air blown from hot air blowing nozzles 62*a* and 62*b* joins together with the high-speed air stream blown from melt blow die 53 and the circulated air stream in a region between melt blow die 53 and rod-like bodies $\mathbf{57}_1$ and $\mathbf{57}_2$, to thereby further promote the attenuating of the filaments and the increase in the width of the obtained web.

The foregoing description will provide an explanation of the present invention with reference to several typical embodiments of the apparatus for manufacturing the transversely aligned web. Other embodiments of the filaments, the spinning device, the air stream vibrating mechanism, and some additional constituents that can be used in the invention will be described below.

(Filaments)

Polymers that are suitable for the filaments to be used in the present invention comprises thermoplastic resin such as polyethylene, polypropylene, polyester, polyamide, poly vinyl chloride based resins, polyurethane, fluorocarbon based polymers and denatures resins thereof. Further, resins obtained by wet process or hot process type spinning device, such as poly vinyl alcohol based resins and polyacrylnitrile based resins might also be used.

Also, filaments made of different kinds of polymers and conjugated filaments disclosed by the present Applicant in International Publication WO 96/17121 may also be used for the present invention.

The filaments used in the present invention belong to long fiber filaments. Generally, the long fiber filaments are considered as filaments of which the average length is more than 100 mm, and therefore the filaments continuously spun by the present invention can be considered to be included in the long fiber filaments. Further, if filaments have the diameter of 50 $\mu$m or more immediately after the spinning, the filaments would be very rigid and would not be intertwined sufficiently. Thus, the filaments used for the present invention should have the diameter of preferably 30 $\mu$m or less, or of more preferably 25 $\mu$m or less. Particularly when a web of increased mechanical strength is desired, the web should desirably be stretched in a transverse direction after the spinning of web. At this case, the diameter of the filaments after being stretched should preferably be 5 $\mu$m or more. The diameter and length of the filaments are measured by enlarged microscopic photography, and the length is indicated on the basis of averaging those of thirty filaments, while the diameter is indicated on the basis of averaging those of a hundred filaments.

(Spinning Device)

As the spinning device for the filaments, the melt-blow method that is a spun-bonding method in broad sense has been described. A further embodiment of the spinning device employing a spun-bonding method of narrow sense will be described below.

Figure 6:
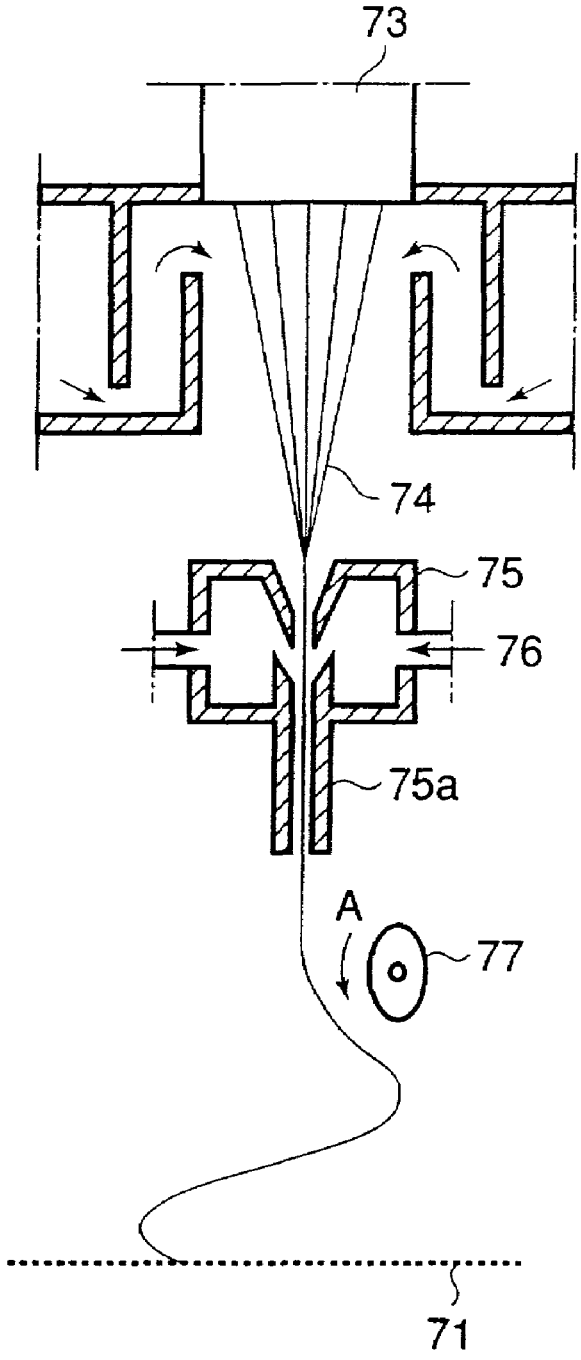
FIG. 6 is a schematic cross-sectional view at the front of a web manufacturing apparatus employing a spun-bonding method in narrow sense.

FIG. 6 is schematic cross-sectional view of a web manufacturing apparatus viewing from the front end thereof, which employs a spun-bonding method in the narrow sense.

In the ordinary spunbonded spinning, a plurality of filaments 74 spun from spun-bonding die 73 having a plurality of spinning holes are sucked by air 76 ejected from ejector 7S, and is accompanied by high-speed air stream accelerated by nozzle 75*a* of ejector 75 so that filaments 74 are piled on conveyor 71. Conveyor 71 is driven by a conveyor roller (not shown) to convey filaments 74 in a direction perpendicular to the sheet surface of FIG. 6 from an inner side toward this side or from this side toward the inner side. A suction box (not shown) similar to that shown in FIG. 3 is disposed at a position under conveyor 71 so that a web having a desired width may be easily obtained.

In region where the high-speed air stream flows between ejector 75 and conveyor 71, rod-like body 77 having an elliptical section is disposed. Rod-like body 77 is substantially identical with that shown in FIG. 1, and is rotated in a direction shown by an arrow "A" in FIG. 6, so that the high-speed air stream is cyclically changed in its flowing direction in a direction cross to the conveying direction of the web by conveyor 71. Hereby, filaments 74 discharged from ejector 75 flow along the air stream that cyclically changes its flowing direction, to thereby be repeatedly folded in a transverse direction while being piled on conveyor 71. As a result, a web having filaments 74 aligned in a transverse direction is manufactured.

When the spinning device according to the present invention carries out a spun-bonding method in narrow sense or a spun lace method, there is a case where the molecular orientation of filaments 74 might have been already performed. However, in that case, alignability of the filaments can be remarkably improved, and accordingly a web having a large transverse strength can be acquired.

If the molecular orientation of filaments is large, the filaments are poor in its stretchability, and therefore their stretching tension is high. As a result, it may be difficult to subsequently stretch the filaments at a high magnification. If subsequently stretching the filaments at a high magnification is necessary, it is effective to cool the filaments immediately underneath the nozzle to reduce the molecular orientation of the filaments.

In a spinning device for a spunbonded fabric in broad sense, there have been provided a mechanism in which filaments are collided against a so-called collision plate (e.g., refer to Japanese Patent Publication Nos. 4026/74 and 24261/93). This collision plate is provided for splitting and spreading the filaments to reduce the anisotropy of a web on the conveyor. In comparison, the air stream vibrating mechanism of the present invention aims to increase the anisotropy of the web, namely to adequately align filaments in the web in one direction. Thus, the air stream vibrating mechanism of the present invention is quite different from the above-mentioned collision plate from the viewpoint of an object and effect. Further, the air stream vibrating mechanism of the present invention does not employ any direct collision of the air stream with the filaments but changes the flow direction of the air stream in the flowing region thereof. Furthermore, the position of the wall surface is changed at an extremely short cycle of time. Therefore, it should be understood that the operation of the air stream vibrating mechanism of the present invention is far different from that of the above-mentioned collision plate.

(Air Stream Vibrating Mechanism)

The air stream vibrating mechanism may be any type of mechanism if it could cyclically and transversely change the flowing direction of the air stream for drafting the filaments.

Various embodiments of the air stream vibrating mechanism will be described below.

Figure 7A:
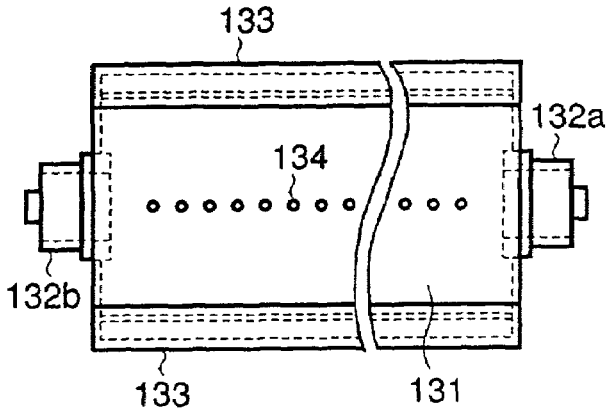
FIG. 7*a* is a front elevational view of an air stream vibrating mechanism having a rotating cylindrical body.
Figure 7B:
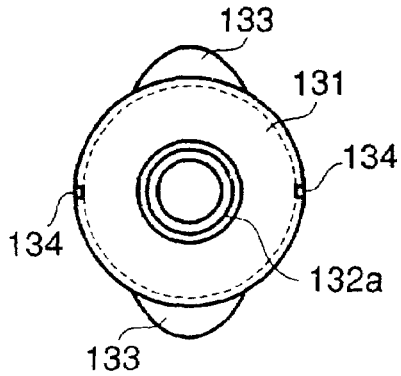
FIG. 7*b* is a side view of the air stream vibrating mechanism shown in FIG. 7*a;*

FIGS. 7*a* and 7*b* illustrate an embodiment of the air stream vibrating mechanism employing a cylindrical body. This air stream vibrating mechanism has cylindrical body 131 as a main constituent thereof. Cylindrical body 131 is provided, at the opposite ends thereof, with integral shafts 132*a* and 132*b* coaxial with the central axis of cylindrical body 131. Shafts 132*a* and 132*b* are rotatably supported and rotated by a non-illustrated drive source so that cylindrical body 131 is rotated about shafts 132*a* and 132*b*. The cylindrical body 131 has a circumferential surface integrally formed with two projections 133, which are shaped to have an extreme end, formed in a rounded surface, respectively. Two projections 133 are aligned at positions opposed to one another with respect to the central axis of cylindrical body 131, and extend along the central axis of cylindrical body 131.

Hereby, when the air stream vibrating mechanism rotates, the circumferential surface of cylindrical body 131 and projections 133 alternately face the air stream axis of the high-speed air stream. When the circumferential surface of cylindrical body 131 faces the air stream axis, the distance between the circumferential surface and the air stream axis is sufficiently large, and accordingly the circumferential surface does not affect the high-speed air stream. When the air stream vibrating mechanism is further rotated until one of projections 133 comes to face the air stream axis, the distance wherefrom to the air stream axis becomes small, and therefore the high-speed air stream flows along the surface of facing projection 133. Accordingly, filaments flowing along the high-speed air stream will be attracted toward cylindrical body 131. As a result, the filaments can be cyclically vibrated as described in connection with the embodiment of FIG. 1.

As illustrated in FIGS. 7*a* and 7*b*, the circumferential surface of cylindrical body 131 may have a plurality of holes 134 defined therein along the central axis thereof ejecting air therefrom. When air is ejected from holes 134, the direction of the high-speed air stream may be changed away from cylindrical body 131 for thereby increasing the extent to which the filaments are vibrated. In this case, one of shaft 132*a* is formed as a hollow shaft so that air may be supplied therethrough into cylindrical body 131. Also, although not shown in FIGS. 7*a* and 7*b*, if projections 133 are provided with holes defined therein for permitting a part of the high-speed air stream to be sucked into inside cylindrical body 131, the high-speed air stream will more positively flow along projections 133. Hereby, it is possible to further increase the extent to which the filaments are vibrated.

Furthermore, in the embodiment of FIGS. 7*a* and 7*b*, although two projections 133 are provided for the circumferential surface of cylindrical body 131, the number of projection may be either reduced to one or increased to three or more, if such projection or projections could cyclically face the high-speed air stream during the rotation of cylindrical body 131 thereby cyclically changing the direction of the high-speed air stream.

Figure 8A:
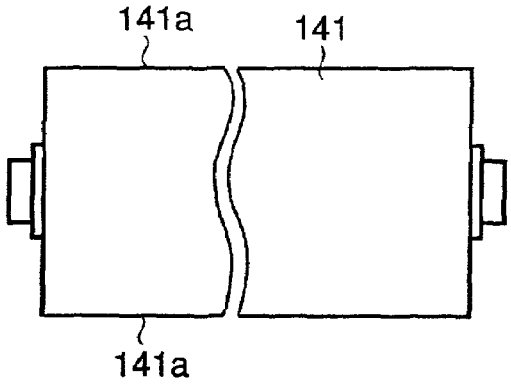
FIG. 8*a* is a front elevational view of an air stream vibrating mechanism having a rotating body in the shape of a triangular prism.
Figure 8B:
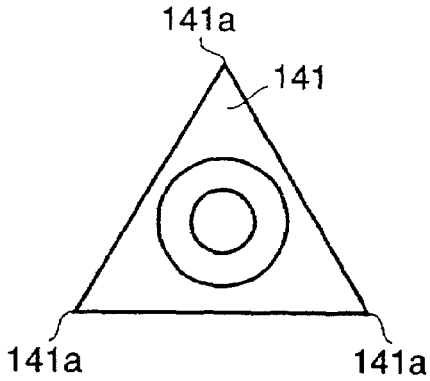
FIG. 8*b* is a side view of the air stream vibrating mechanism shown in FIG. 8*a;*

FIGS. 8*a* and 8*b* illustrate an embodiment of the air stream vibrating mechanism having triangular cross section. The air stream vibrating mechanism of FIGS. 8*a* and 8*b* has rotating body 141 in the shape of a triangular prism, which is rotated to change the direction of the high-speed air stream. During the rotation of this rotating body 141, when edge portion 141*a* thereof approaches the air stream axis of the high-speed air stream, the high-speed air stream tends to flow along a wall surface of rotating body 141, which is located downstream side of each edge portion 141*a*. On the other hand, when edge portion 141*a* moves away from the air stream axis, the high-speed air stream tends to flow without being affected by the wall surface of rotating body 141. This change in the direction of flow of the high-speed air stream can allow the filaments to be vibrated in a transverse direction.

In FIGS. 8*a* and 8*b*, although an embodiment is shown in which the air stream vibrating mechanism has a triangular cross section, the mechanism is not limited to the triangular cross section. Namely, if the rotating body has a regular polygonal cross section such as a square cross section or an equitransverse pentagonal cross section, the distance between the air stream axis of the high-speed air stream and the wall surface of the air stream vibrating mechanism can be cyclically changed, and therefore an identical effect with the case of triangular cross section can be achieved.

Figure 9A:
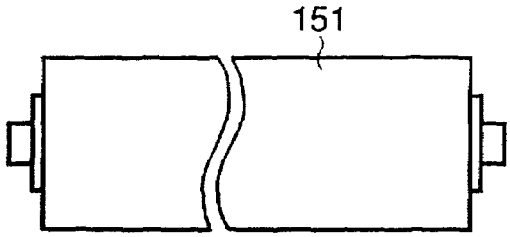
FIG. 9*a* is a front elevational view of an air stream vibrating mechanism having a rotating body in the shape of a quadrangular prism.
Figure 9B:
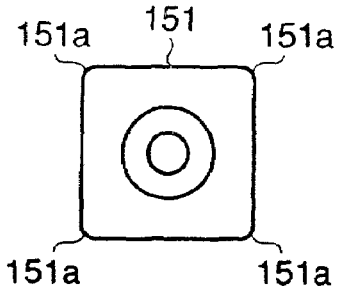
FIG. 9*b* is a side view of the air stream vibrating mechanism shown in FIG. 9*a;*

FIGS. 9*a* and 9*b* illustrates an embodiment of the air stream vibrating mechanism having a square cross section. The air stream vibrating mechanism of FIGS. 9*a* and 9*b* is a modification of that shown in FIGS. 8*a* and 8*b*. Thus, rotating body 151 in the shape of a quadrangular prism has edge portions 151*a* each machined into a curved surface, so that adjacent wall surfaces are smoothly joined each other. Thus, during the rotation of rotating body 152, when edge portion 151*a* comes close to and moves away from the air stream axis of the high-speed air stream, the direction of the high-speed air stream smoothly changes. As required, the above-mentioned rounded work may be applied not only to edge portions 151*a* but also to respective sidewall surfaces of rotating body 151 to achieve similar advantageous effect.

Figure 10:
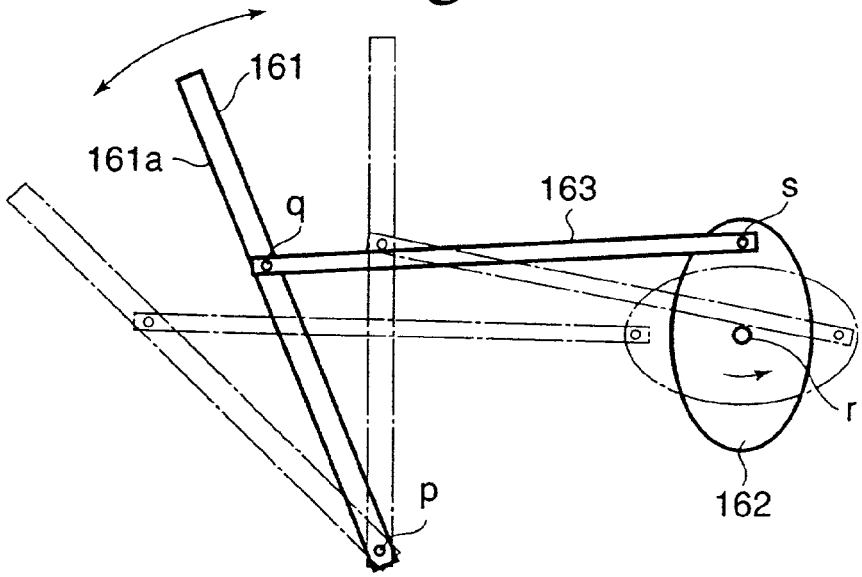
FIG. 10 is a side view of an example of an air stream vibrating mechanism having a swingable plate member.

FIG. 10 illustrates a side elevation of an embodiment of the air stream vibrating mechanism, which changes the direction of the high-speed air stream by not the rotating operation but a swinging operation. In FIG. 10, plate member 161 having main surface 161*a* which faces the high-speed air stream is supported at its lower end on a shaft extending in a direction cross to the transverse direction of a web to be manufactured. It should be noted that the direction cross to the transverse direction corresponds to a direction parallel with the machine direction of a non-illustrated conveyor. That is to say, plate member 161 is disposed to be swingable about a point "p" in its lowermost end. Further, plate member 161 is operatively connected, at its vertically middle portion, to rotating member 162 rotating about rotating axis "r", with connecting rod 163. Connecting rod 163 has one end swingably connected to rotating member 162 at an eccentric point "s", and the other end swingably connected to plate member 161 at the vertically middle point "q".

Thus, when rotating member 162 rotates, plate member 161 is swung about point "p" in a range between a position indicated by one-dot chain line and another position indicated by two-dot chain line in FIG. 10. Concerning the swinging range of plate member 161, the distance between rotating axis "r" and eccentric point "s", and the distance between point "p" and point "q" are preliminarily set so that when the uppermost end of plate member 161 is moved farthest away from the air stream axis, main surface 161*a* is brought parallel to the air stream axis. Therefore, when plate member 161 is in the position shown by one-dot chain line, the direction of the high-speed air stream is not changed, and when the uppermost end of plate member 161 gradually comes close to the air stream axis while tilting main surface 161*a* of plate member 161, the high-speed air stream tends to flow along main surface 161*a*, changing its direction toward the right. Namely, swinging motion to plate member 161 can cause a cyclic change in the direction of the high-speed air stream.

Figure 11:
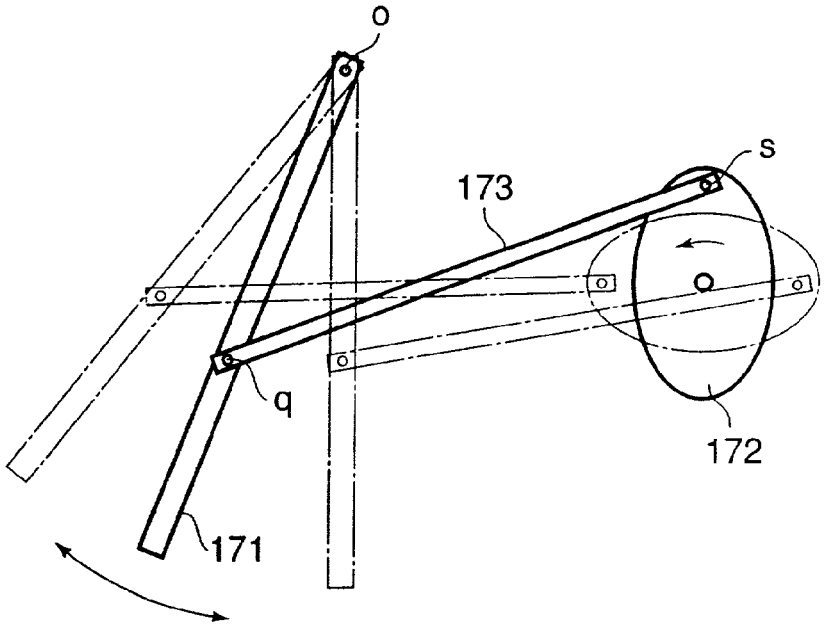
FIG. 11 is a side view of another example of an air stream vibrating mechanism having a swingable plate member.

FIG. 11 illustrates a mechanism for changing the direction of the high-speed air stream by the utilization of swinging motion in a manner similar to that of FIG. 10. In the mechanism of FIG. 11, plate member 171 is swingable about point "o" that is located at not the lowermost end but the uppermost end of Plate member 171. The other mechanism is similar to that of FIG. 10. Namely, plate member 171 is operatively connected to rotating member 712 with connecting rod 173, connecting rod 173 is connected to plate member 171 at point "q", and connecting rod 173 is connected to rotating member 172 at eccentric point "s". In the mechanism shown in FIG. 11, plate member 171 is swung about point "o" in a range between a position indicated by one-dot chain line and another position indicated by two-dot chain line.

Based on the described construction, when plate member 171 is swung, it is possible to cyclically change the direction of the high-speed air stream in a manner that the air stream is repelled away from plate member 171 and is not attracted toward plate member 171.

In the embodiments shown in FIGS. 10 and 11, although plate members 161 and 171 are formed of a flat plate, respectively, curved plates may be used for the purpose of increasing the extent to which the high-speed air stream is vibrated, that is to say, the extent to which the filaments are vibrated.

With several embodiments of the air stream vibrating mechanism suitable for the present invention, the above description has been provided to explain one in which the direction of the high-speed air stream is changed with the rotatable member, and the other in which the direction of the high-speed air stream is changed with the swingable member. However, the present invention is not limited to these embodiments, and as required, it may be possible to use a further mechanism which has a wall surface inclined from the air stream axis of the high-speed air stream, and a distance between the wall surface and the air stream axis of the high-speed air stream is changed by only a parallel movement of the wall surface to cause Coanda effect. Furthermore, if the alignability of filaments in the transverse direction could be increased while acquiring a web having a large width at a high yield, the arrangement and the number of the air stream vibrating mechanism may be not be limited. Of course, it should be understood that the above various embodiments of the air stream vibrating mechanism may be applicable to the web manufacturing apparatus as described with reference to FIGS. 1 through 6.

(Additional Constituent Elements)

The alignability of filaments in the transverse direction can further be improved by stretching the web in the transverse direction. Accordingly, it is preferred that a stretching device is additionally provided for further transversely stretching the web in which the filaments are aligned in the transverse direction. In this case, the better the alignability of filaments in the transverse direction is, the higher the probability that the filaments are practically stretched during the transverse stretching of the web becomes, and as a result, the mechanical strength of the finally stretched web will be great. If the alignability of filaments were poor, only the folded structure of filaments and the distance between the filaments would be increased by stretching the web, and the probability that filaments are substantially stretched would be lowered, and accordingly a sufficient strength after stretching could not be obtained.

Now, in the ordinary melt-blow spinning, filaments are rectilinearly collided with the conveyor together with hot air, and therefore a time for the filaments to reach the conveyor, i.e., a cooling time is short. Also, if the distance from the nozzles to the conveyor is excessively large, the formation of the web (i.e., partial uniformity in the basis weight of the web) is deteriorated. Accordingly, in the ordinary melt-blow spinning, the distance between the nozzles and the conveyor is about 300 mm. To the contrary, in the present invention, since the filaments are largely vibrated, the time for the filaments to reach the conveyor will long. Accordingly, even if a short distance is set between the spinning apparatus and the conveyor, the filaments can be well cooled. Further, as a result of experiments, it was clarified that the formation of the web was rather improved despite that the reason is not clear.

The obtained web can be used as it is. However, as described above, the alignability of filaments will be further improved by stretching the web. Therefore, the spinning device may produce a web made of filaments having a good stretchability. Thus, it is necessary to cool the filaments sufficiently quickly to produce a web of filaments that have small stretching stress and are stretched largely. The most effective way to meet such a requirement is to provide a spray nozzle (not shown) between the spinning apparatus and the conveyor, for spraying mist of water into the high-speed air stream, so that the air stream contains therein mist.

Adding an oil that is a so-called spinning/stretching oil and capable of imparting stretching and static electricity removing property to the mist would be effective in improving the subsequent stretching ability, reducing nap, and enhancing the strength and elongation of the stretched web. It should be understood that if the fluid sprayed from the spray nozzle could cool the filaments, it might not necessarily contain water but might be cold air.

As a device for further transversely stretching the web having filaments aligned in a transverse direction, various conventional stretching devices would be used. For example, a tenter type transversely stretching device used for biaxial stretching of a film, a pulley type transversely stretching device disclosed in Japanese Patent Publication No. 36948/91, and a groove-roller type transversely stretching device provided with two grooved rollers in which circumferential grooves are formed, for nipping the web to stretch the web in the transverse direction may be used. In these stretching devices, the pulley type transversely stretching device can be a less expensive and simple device. In addition, the pulley type transversely stretching device can freely change stretching magnification of the web and realize stretching at high magnification. Therefore, the pulley type transversely stretching device is the most suitable for the use in the present invention.

Now, if it is desired that the width of the web is extremely large, a preliminary stretching at a temperature higher than an ordinary stretching temperature (5 through 10° C. in the case of polyester, and 20 through 30° C. in the case of polypropylene) should preferably be executed before the transverse stretching at the ordinary stretching temperature. This transverse stretching may be achieved by the use of the above-described transversely stretching device.

In the transverse stretching of the web, if the web is slightly embossed before stretching, the stretching magnification can be increased to thereby increase the mechanical strength of the web after stretching. In addition, stable stretching of the web without cutring of the filaments during the stretching can be achieved. In this case, embossing pattern should desirably be a pattern having orientation in the longitudinal direction of the web. An embossing temperature should preferably be set at temperature lower than the stretching temperature +5° C. An embossing pressure should preferably be 3 N/cm through 50 N/cm at a line pressure because an excessive pressure damages the filaments and causes cutting of the filaments during stretching. The embossing pressure should more preferably be 8 N/cm through 30 N/cm, and most preferably be 10 N/cm through 25 n/cm. If the embossing is applied with an embossing roller or rollers, the web is not be uniformly pressurized at its entire width by the embossing roller, and the embossing pressure is not be applied to respective points of the web to be embossed. However, the embossing applied at this step may be executed under a rather small embossing pressure, and does not require strict calculation of the embossing pressure. Thus, the embossing pressure at this case can be defined similarly to the case of an ordinary line pressure by the equation shown-below.

Line pressure (N/Cm)=Pressing force (N)/Width of an embossing roller (cm)

The stretching magnification the web will be changed depending on the type of polymer of filament that constitutes the web, the spinning device and the aligning device for the web, the desired mechanical strength and elongation in the transverse and the longitudinal direction, etc. However, regardless of which type of polymer and device are employed, the stretching magnification is selected so as to achieve the high stretching ability and mechanical strength of the web according to the object of the present invention.

The stretching magnification is defined by the following equation, depending on marks applied to the web to be stretched at constant intervals in the direction in which the web is to be stretched.

Stretching magnification=[Length between the marks after stretching]/[Length between the marks before stretching]

The stretching magnification mentioned here does not necessarily mean the stretching magnification of each filament, as is the case with the stretching of an ordinary long-fiber filament yarn.

Figure 12A:
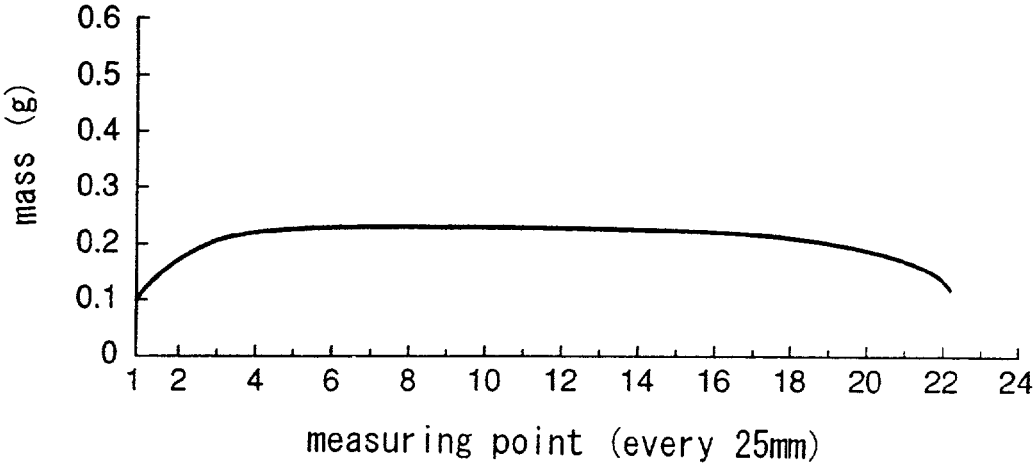
FIG. 12*a* is a diagram indicating a width profile of a transversely aligned web obtained according to the present invention.
Figure 12B:
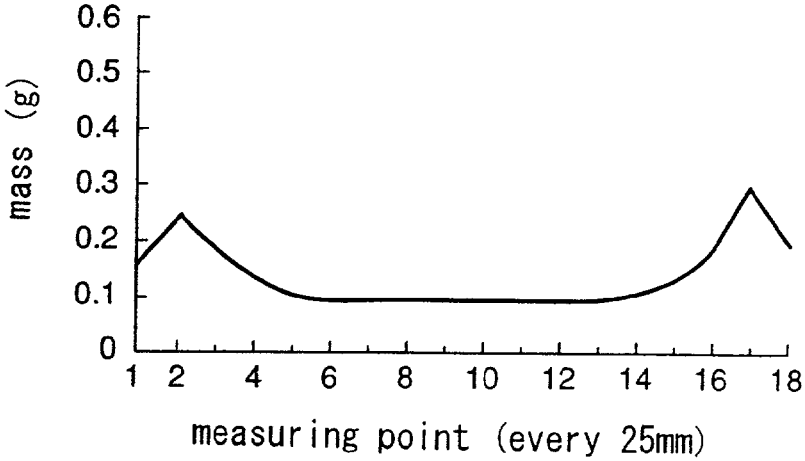
FIG. 12*b* is diagram indicating a width profile of a transversely aligned web obtained according to a spray method.

In FIG. 12*a*, an example of mass distribution in a transverse direction of a transversely aligned web, acquired by the present invention is indicated, and in FIG. 12*b*, an example of mass distribution in a transverse direction of a transversely aligned web, manufactured by a spray method is indicated. The mass distribution in the transverse direction of the web is referred to as the profile of the web.

The profile of the web can be obtained by cutting the web in transverse direction to get a sample web of 100 mm in length, cutting the sample web into pieces having 25 mm in width, and measuring mass of each piece.

The web having the profile shown in FIG. 12*a* has an approximately uniform mass distribution in the transverse direction. The mass at both end portions of the web in the transverse direction is slightly smaller than that of the other portion of the web, namely, the thickness of the respective end portions is reduced compared with that of the other portion of the web. This characteristic is very advantageous for the case where the web is transversely stretched. The reason is as follows. When the web is transversely stretched, the both ends in the transverse direction of the web are ordinarily nipped during stretching of the web in the transverse direction. Therefore, the nipped ends of the web would not be substantially stretched and accordingly, the thickness of the nipped ends is not reduced. As a result, the mass distribution of the web in the transverse direction can be made uniform by stretching.

On the other hand, in the case of the web having the profile shown in FIG. 12*b*, the mass at both ends of the web in the transverse direction is larger than that of the other portion of the web, namely, the respective ends is thicker than the other portion of the web. When the web of FIG. 12*b* is compared with that of FIG. 12*a*, it will be understood that the latter web of FIG. 12*a* is uniform in its mass distribution in the transverse direction thereof, and the entire width of the web of FIG. 12*a* can be large.

The web manufactured according to the present invention may be directly used as a web that is required to have a large strength in the transverse direction, and in addition it may be used as laminated on a paper, a nonwoven fabric, cloths, or a film for reinforcing the mechanical strength thereof in the transverse direction. Furthermore, when the web according to the present invention is stretched, it can have a good gloss, and accordingly it can be used as packing material by utilization of the brilliance thereof. Further, the transversely stretches web acquired by transversely stretching the web manufactured according to the present invention can used as a raw material web for a perpendicularly laminated nonwoven fabric and a obliquely laminated nonwoven fabric as disclosed in Japanese Patent Publication No. 36948/91, Japanese Laid-open Patent Publication No. 269859/90, Japanese Laid-open Patent Publication No. 242960/90, and International Publication WO96/17121, that are the prior inventions made by the present inventors.

Concrete examples of the present invention will be described below.

EXAMPLE 1-1

As a spinning device, a melt blow die was used in which the diameter of each nozzle is 0.3 mm, a nozzle pitch is 1.0 mm, and a spinning breadth is 500 mm. The melt blow die was disposed to be parallel with an machine direction of a conveyor. A melt polyethyleneterephthalate resin having an intrinsic viscosity of 0.62 dl/g was used as a material for filaments. The melt resin was extruded from the melt blow die as filaments at a discharge rate of 0.35 g/min per one nozzle at a die temperature of 320° C. A high-speed air stream for attenuating the extruded filaments was set at a temperature of 370° C., and at a flow rate of 1,000 Nl/min. As an air stream vibrating mechanism, a single rod-like body having an elliptical cross section, as shown in FIG. 1, was used. This rod-like body had lengths of 60 mm and 90 mm in miner and main axes of the cross section, and was disposed so that L1 and L2 shown in FIG. 1 were set at 15 mm and 55 mm, respectively. Further, the rotation speed of the rod-like body was 600 r.p.m. (Since the rod-like body has the elliptical cross-section and it has two portions that come nearest to the air stream axis during one complete rotation of the body, the frequency of the air stream was 20 Hz.), and the filaments were transversely vibrated. The rotating direction of the rod-like body was set in the arrow "A" direction shown in FIG. 1. The obtained web was stretched in a transverse direction in hot air of 90° C. by the use of a pulley type stretching device to manufacture a transversely stretched web.

EXAMPLE 1-2

A transversely stretched web was manufactured under the same conditions as the above-mentioned conditions of the example 1-1 except that the rotating direction of the rod-like body was set in a direction reverse to that of the example 1-1.

EXAMPLE 2-1

The spinning condition of filaments was the same as that of the example 1-1. As an air stream vibrating mechanism, two rod-like bodies, each being the same as that of the example 1-1 were disposed to be symmetrical with respect as that of the example 1-1 to manufacture a transversely stretched web. The embossing pattern was a pattern such that the stripes of 10 mm in length at intervals of 5 mm in a longitudinal direction are arranged in a cross stitched pattern. The embossing temperature was 70° C., and the line pressure was set at 15 N/cm.

EXAMPLE 2-2

A transversely stretched web was manufactured under the same conditions as those of the example 2-1 except that the frequency of the air stream due to the rotation of the rod-like bodies was set at 23 Hz.

EXAMPLE 3-1

The same apparatus as that of example 2-1 together with side plates as shown in FIG. 5 were used, and the frequency of the air stream was set at 17 Hz. The other conditions were set to be the same as those of the example 2-1 to manufacture a transversely stretched web.

EXAMPLE 3-2

In addition to the apparatus as used in the example 3-1, hot air supply nozzles were disposed on both sides of the rod-like bodies for blowing a hot air toward a region between the die and the rod-like bodies. The other conditions were set to be the same as those of the example 3-1 to manufacture a transversely stretched web. The temperature of the hot air blown from the hot air supply nozzles was 105° C., and the flow late of hot air blown from each nozzle was set at 1.2 $m^3$/min.

EXAMPLE 4

A transversely stretched web was manufactured under the same conditions as those of the example 3-2 except that the L1 and L2 shown in FIG. 1 were set at 10 mm and 52 mm respectively.

EXAMPLE 5

A transversely stretched web was manufactured under the same conditions as those of the example 1-1 except that a spun bonding die shown in FIG. 6 was employed instead of the melt blow die.

COMPARATIVE EXAMPLE 1

A transversely stretched web was manufactured under the same conditions as those of the example 1-1 except that air stream vibrating mechanism was not used.

Table 1 indicates the primary conditions of the above-mentioned respective examples and the comparative example, and the result of measurement of the breaking strength and the breaking elongation of the obtained webs. Further, in Table 1, the measured values of the breaking strength and the breaking elongation of a commercial spun bonded nonwoven fabric (the comparative example 2) and a commercial melt blow nonwoven fabric (the comparative example 3) are also indicated for the reference.

In Table 1, "MB" indicates, "melt blow", and "SB" indicates, "Spun bond". Further, the breaking strength and the breaking elongation in Table 1 were based on the testing method of the long-fiber filaments nonwoven fabric as standardized in JIS L 1906, and were measured as respects the transverse direction. Further, in JIS (Japanese Industrial Standard), though the breaking strength is expressed as a breaking load per 5 cm of web length, the webs used as test pieces in the present experimental measurements had different basis weights. Thus, the mass of each of the measured webs was converted into the tex (the mass per 1,000 m of filament), and the breaking strength was expressed as strength as per one tex (mN/tex) in Table 1.

| | Material resin | Die | Air stream vibrating mechanism L1/L2 (mm) | Frequency (Hz) | Spinning chamber side plates | Hot air jetting | Extent to which filaments are vibrated (mm) | Embossing | Stretching magunification | Breaking strength (mN/tex) | Elongation (%) |
|---|---|---|---|---|---|---|---|---|---|---|---|
| Ex. 1-1 | PET (1) | MB | Single elliptic rod 15/55 | 20 | x | x | 240 | x | 4.5 | 159 | 18 |
| Ex. 1-2 | ↑ | ↑ | ↑ (Reverse rotation) | ↑ | ↑ | ↑ | 220 | ↑ | 4.2 | 141 | 17 |
| Ex. 2-1 | ↑ | ↑ | A pair of elliptic rod 15/55 | 13.5 | ↑ | ↑ | 380 | ○ | 4.7 | 168 | 22 |
| Ex. 2-2 | ↑ | ↑ | ↑ | 23 | ↑ | ↑ | 270 | ↑ | 4.8 | 194 | 21 |
| Ex. 3-1 | ↑ | ↑ | ↑ | 17 | ↑ | ↑ | 410 | ↑ | 4.7 | 168 | 22 |
| Ex. 3-2 | ↑ | ↑ | ↑ | ↑ | ○ | ○ | 530 | ↑ | 4.8 | 203 | 21 |
| Ex. 4 | ↑ | ↑ | A pair of elliptic rod 10/52 | ↑ | ↑ | ↑ | 580 | ↑ | 4.7 | 212 | 22 |
| Ex. 5 | ↑ | SB | Single elliptic rod 15/55 | 20 | x | x | 210 | x | 4.5 | 241 | 18 |

-continued

| | Material resin | Die | Air stream vibrating mechanism L1/L2 (mm) | Frequency (Hz) | Spinning chamber side plates | Hot air jetting | Extent to which filaments are vibrated (mm) | Embossing | Stretching magunification | Breaking strength (mN/tex) | Elongation (%) |
|---|---|---|---|---|---|---|---|---|---|---|---|
| Co.Ex. 1 | PET | MB | x | — | — | — | 110 | x | 2.5 | 89 | 6 |
| Co.Ex. 2 | PET | SB | — | — | — | — | — | — | — | 46 | 29 |
| Co.Ex. 3 | PP | MB | — | — | — | — | — | — | — | 15 | 19 |

From the results indicated in Table 1, the following can be understood.

In comparison between Examples 2-1 and 2-2, it is understood that when the frequency is small, the vibrating width in the filaments becomes large. On the contrary, when the frequency is large, the vibrating width of the filaments becomes small. However, the larger the frequency is, the better the alignability of filaments and the weave of the webs are.

In comparison between Examples 3-1 and 3-2, it is understood that when the hot air supply nozzles are disposed in the spinning chamber, the vibrating width of the filaments can be made larger.

In comparison between Examples 3-2 and 4, it is understood that when the air stream vibrating mechanism is disposed in close to the nozzles of the die, the vibrating width of the filaments can be made larger. In addition, the weave and the profile of the webs can be made better.

In comparison between Examples 1-1 and 5, it is understood that the employment of the spun bonding die makes it possible to obtain a web similar to that obtained by the melt blow die. However, the breaking strength is more excellent in the case of the employment of the spun-bonding die.

Although certain preferred embodiments of the present invention have been shown and described, it should be understood that various changes and modifications might be made without departing from the spirit or scope of the appended claims.

What is claimed is:

1. A method of manufacturing a transversely aligned web in which filaments are aligned in a transverse direction, comprising the steps of:

preparing a spinning means including a plurality of nozzles arranged in parallel with a machine direction of a conveyer for extruding molten polymer in the form of filaments, a high-speed fluid blowing unit for blowing a high-speed fluid in a direction parallel with an extruding direction of the filaments to thereby attenuate the filaments extruded from said plurality of nozzles, and at least one air stream vibrating means for cyclically changing a flowing direction of the high-speed fluid blown from said high-speed fluid blowing unit toward the direction cross to the machine direction of said conveyor;

extruding the molten polymer in the form of the filaments from said nozzles;

blowing said high-speed fluid to attenuate the filaments extruded from said nozzles by a frictional force applied by said high-speed fluid; and changing cyclically the flowing direction of said high-speed fluid by said air stream vibrating means to thereby while cyclically changing a movement of said filaments in the direction cross to said machine direction, accumulating said filaments onto said conveyor, wherein the air stream vibration means includes a member which rotates or swings around an axis parallel with the machine direction of the conveyor.

2. The method of manufacturing a transversely aligned web according to claim 1, wherein said step of preparing said air stream vibrating means includes disposing a pair of air stream vibrating means to be opposed to one another while being spaced apart from one another in a direction cross to the machine direction of said conveyor, and wherein said step of extruding the filaments includes extruding the filaments in a region between said pair of air stream vibrating means.

3. The method of manufacturing a transversely aligned web according to claim 1, further comprising a step of circulating said high-speed fluid blown from said high-speed fluid blowing unit in a passageway different from the passageway of said high-speed fluid from said spinning means to said conveyor.

4. The method of manufacturing a transversely aligned web according to claim 3, wherein said step of blowing said high-speed fluid includes blowing a hot air having a temperature higher than the melting temperature of said filaments toward said high-speed fluid at a position upstream of said air stream vibrating means with respect to the flowing direction of said high-speed fluid.

5. The method of manufacturing a transversely aligned web according to claim 1, further comprising a step of spraying a liquid on said high-speed fluid to thereby cool said high-speed fluid.

6. The method of manufacturing a transversely aligned web according to claim 1, further comprising a step of stretching the web composed of the filaments piled on said conveyor in a transverse direction of said web.

7. The method of manufacturing a transversely aligned web according to claim 1, wherein the filaments extend continuously from one edge to the other edge in the width direction of the transversely aligned web.

8. A The method of manufacturing a transversely aligned web according to claim 6, wherein said step of stretching the web includes nipping both edges of the web.

9. The method of manufacturing a transversely aligned web in which filaments are aligned in a transversely direction, comprising the steps of:

preparing a spinning means having a plurality of nozzles arranged in parallel with an machine direction of a conveyer for extruding molten polymer in the form of filaments and a high-speed fluid blowing unit for blowing a high speed fluid in a direction parallel with the extruding direction of the filaments to thereby attenuate the filaments extruded from said nozzles, and at least one air stream vibrating means for cyclically changing the flowing direction of the high speed fluid blown from said high-speed fluid blowing unit toward the direction cross to the machine direction of said conveyor;

extruding the molten polymer in the form of the filaments from said nozzles;

blowing said high-speed fluid to attenuate the filaments extruded from said nozzles by a frictional force applied by said high-speed fluid; and changing cyclically the flow direction of said high-speed fluid by said air stream vibrating means to thereby while cyclically changing a movement of said filaments in the direction cross to said machine direction, accumulating said filaments onto said conveyor, wherein the air stream vibrating means includes a rod-shaped body including an elliptical cross-section and which rotates for cyclically changing the flowing direction of the high-speed fluid.

10. The method of manufacturing a transversely aligned web according to claim 9, wherein said step of preparing said air stream vibrating means includes disposing a pair of air stream vibrating means to be opposed to one another while being spaced apart from one another in a direction cross to the machine direction of said conveyor, and wherein said step of extruding the filaments includes extruding the filaments in a region between said pair of air stream vibrating means.

11. The method of manufacturing a transversely aligned web according to claim 9, further comprising a step of circulating said high-speed fluid blown from said high-speed fluid blowing unit in a passageway different from the passageway of said high-speed fluid from said spinning means to said conveyor.

12. The method of manufacturing a transversely aligned web according to claim 11, wherein said step of blowing said high-speed fluid includes blowing a hot air having a temperature higher than the melting temperature of said filaments toward said high-speed fluid at a position upstream of said air stream vibrating means with respect to the flowing direction of said high-speed fluid.

13. The method of manufacturing a transversely aligned web according to claim 9, further comprising a step of spraying a liquid on said high-speed fluid to thereby cool said high-speed fluid.

14. The method of manufacturing a transversely aligned web according to claim 9, further comprising a step of stretching the web composed of the filaments piled on said conveyor in a transverse direction of said web.

15. A The method of manufacturing a transversely aligned web according to claim 14, wherein said step of stretching the web includes nipping both edges of the web.

16. The method of manufacturing a transversely aligned web according to claim 9, wherein the filaments extend continuously from one edge to the other edge in the width direction of the transversely aligned web.

* * * * *